US007238115B2

(12) United States Patent
Cox

(10) Patent No.: US 7,238,115 B2
(45) Date of Patent: Jul. 3, 2007

(54) ROADWAY-TRANSPORTABLE ARTIFICIAL GOLF PRACTICE GREEN APPARATUS

(76) Inventor: Alvin E. Cox, 10612 Hambletonian Pl., Santa Ana, CA (US) 92705

( * ) Notice: Subject to any disclaimer, the term of this patent is extended or adjusted under 35 U.S.C. 154(b) by 0 days.

(21) Appl. No.: 11/346,115

(22) Filed: Feb. 2, 2006

(65) Prior Publication Data

US 2006/0128490 A1 Jun. 15, 2006

Related U.S. Application Data

(62) Division of application No. 10/750,412, filed on Dec. 30, 2003, now abandoned.

(51) Int. Cl.
*A63B 69/36* (2006.01)

(52) U.S. Cl. ..... 473/168; 473/162; 473/192

(58) Field of Classification Search ..... 473/167–170, 473/173, 190–192, 195, 196, 197, 150, 151, 473/162

See application file for complete search history.

(56) References Cited

U.S. PATENT DOCUMENTS

| | | | |
|---|---|---|---|
| 1,870,536 | A | 8/1932 | Vaccaro, Jr. |
| 1,897,289 | A | 2/1933 | Wieden |
| 3,831,949 | A | 8/1974 | Henning |
| 3,871,661 | A | 3/1975 | Korff |
| 3,936,055 | A | 2/1976 | Scott |
| 4,006,907 | A | 2/1977 | Heffley, Jr. |
| 4,045,023 | A | 8/1977 | Heffley, Jr. |
| 4,202,547 | A | 5/1980 | Mueller |
| 4,211,417 | A | 7/1980 | Brown |
| 4,905,996 | A | 3/1990 | Tallent et al. |
| 5,042,813 | A | 8/1991 | Huang |
| 5,163,677 | A | 11/1992 | Foley |
| 5,219,161 | A | 6/1993 | Williams, Sr. |
| 5,234,215 | A | 8/1993 | Uehara |
| 5,445,381 | A | 8/1995 | Van Ert |
| 5,580,320 | A | 12/1996 | Meikle |
| 5,803,820 | A | 9/1998 | McCarty |
| 5,980,392 | A | 11/1999 | Cox |
| 6,398,662 | B1 | 6/2002 | Cox |
| 6,447,400 | B1 | 9/2002 | Wilk |
| 6,746,338 | B1 | 6/2004 | Keaton |

OTHER PUBLICATIONS

PCT International Search Report, PCT/US2004/043814 dated Jun. 24, 2005.

*Primary Examiner*—Mark S. Graham
(74) *Attorney, Agent, or Firm*—TraskBritt

(57) ABSTRACT

A golf practice green apparatus is provided which is capable of transforming between multiple configurations. A first configuration is best suited for actual use as a target green on a golf driving range or the like. In a second configuration the effective width or other dimension of the apparatus is significantly reduced to allow for practical and legal transportation of the golf practice green apparatus over a roadway.

9 Claims, 4 Drawing Sheets

ROADWAY-TRANSPORTABLE ARTIFICIAL GOLF PRACTICE GREEN APPARATUS

CROSS-REFERENCE TO RELATED APPLICATION

This application is a divisional of application Ser. No. 10/750,412, filed Dec. 30, 2003, abandoned.

BACKGROUND OF THE INVENTION

1. Field of the Invention

The present invention relates to apparatus for use as golf target practice greens. Such artificial greens are often used at golf driving ranges or special event competitions. In particular, the present invention relates to a golf practice green which can attain more than one configuration. One configuration will be for use as a target green and another configuration is better suited for highway transportation or to facilitate storage.

2. State of the Art

Golf practice greens are commonly used on golf course driving ranges to aid golfers in improving their accuracy in hitting golf balls to a desired target, such as the golf hole or pin. Artificial practice greens are often preferable over a natural green (a green and hole placed in the grass itself as is found on golf courses) because their position on the driving range can be changed very easily, they require much less maintenance such as mowing and watering, and they can be designed to incorporate additional functional features that would be difficult or impossible to incorporate into a natural practice green.

Several artificial golf practice greens have been heretofore developed incorporating means for relaying information to the golfer about his particular stroke, such as how far the golf ball traveled, whether the golf ball struck the target green, and if so, the particular location on the target green where the ball landed. Examples of such devices have been disclosed by Heffley, Jr., U.S. Pat. No. 4,045,023 (issued Aug. 30, 1977), and Foley, U.S. Pat. No. 5,163,677 (issued Nov. 17, 1992).

In addition, in order to allow golfers to practice shots of varying distance, mobile artificial golf practice greens have been developed to accommodate the transportation of the green to different locations along the range. Mueller, U.S. Pat. No. 4,202,547 (issued May 13, 1980), discloses a movable golf green apparatus mounted on a frame with wheels and a motor that travels a track that runs along the driving range. A similar device is also disclosed by Uehara, U.S. Pat. No. 5,234,215 (issued Aug. 10, 1993).

Artificial golf practice greens have also been developed with sloped or contoured surfaces to allow the golf balls to roll off after landing thereon so that subsequent golfers do not have to worry about their ball striking a ball previously hit onto the green and deflecting their shot. Such greens are disclosed by Williams, Sr., U.S. Pat. No. 5,219,161 (issued Jun. 15, 1993), and Meikle, U.S. Pat. No. 5,580,320 (issued Dec. 3, 1996).

Cox, in U.S. Pat. No. 5,980,392 (issued Nov. 9, 1999) and U.S. Pat. No. 6,398,662 (issued Jun. 4, 2002) has also disclosed self propelled artificial practice greens incorporating many of the advantageous features of previously disclosed golf green apparatus, but also having means for collecting golf balls lying on the driving range that have previously been hit by golfers, thereby eliminating the need for driving range operators to use a separate vehicle or employee to retrieve balls from the range. The disclosure of each of these patents is hereby incorporated herein by reference.

BRIEF SUMMARY OF THE INVENTION

The present invention relates to a transportable artificial golf practice green having means for reducing the width thereof to allow for the device to be legally transported over a roadway. Several embodiments of the present invention are disclosed herein that facilitate the temporary reduction of the effective width of a golf practice green to within dimensions prescribed by applicable laws for transportation over highways. Such an apparatus allows for a driving range operator to transport one practice green between two different ranges, or between a driving range and the location of a special event or competition, etc. Such transportation has been heretofore impossible or very difficult given the typical size of golf practice greens, often requiring the greens to be significantly disassembled, transported in pieces, and reassembled at the new location.

To overcome such limitations, the present invention discloses a golf practice green having a target surface comprising at least two panels which are interconnected such that the green is capable of differing configurations between a first configuration for use, and a second configuration, having a reduced effective width, for transportation. The structure of the practice green is such that the change from one configuration to the other does not require any disassembly and may be done quickly.

In a first embodiment of the instant invention, the generally circular or oval practice green has three panels comprising a center panel and two side panels attached to the center panel with hinges or other means which permit the side panels to rotate with respect to the center panel which remains in a fixed position. In the first configuration, the panels are extended such that the upper surfaces of the panels form a planar coextensive target surface, generally positioned substantially horizontally for use as a practice green. In the second configuration, the side panels are folded at the hinges to a position above the center panel, thereby reducing the effective width of the green, allowing it to be quickly positioned on a vehicle for transportation.

In a second embodiment, the practice green comprises three panels as in the first embodiment; however, in the second embodiment, the center panel is mounted on a support frame having an axle and wheels and means for attachment to a vehicle for towing. In the first configuration, the panels are extended such that the upper surfaces of the panels form a planar coextensive target surface. In the second configuration, the side panels are folded downward 90° at the hinges to reduce the effective width, allowing the green to be quickly towed behind another vehicle for transportation over a roadway or to another location on a golf driving range.

In a third embodiment, of the instant invention, the practice green comprises three panels as in the first and second embodiments; however, in the third embodiment, the center panel is mounted on a support frame having collapsible legs. In the first configuration, the panels are extended such that the upper surfaces of the panels form a planar coextensive target surface when the collapsible legs are extended. In the second configuration, the collapsible legs are collapsed, and the side panels are folded upwards at the hinges to reduce the effective width. This configuration allows a separate trailer to be positioned underneath the green while it is in the first configuration, after which the legs are collapsed allowing the green to rest on the trailer, then the side panels are folded upwards over the center panel, allowing the green to be quickly and easily placed on a trailer and towed behind another vehicle for transportation over a roadway.

In a fourth embodiment of the instant invention, the practice green comprises a pair of panels mounted on two horizontally extending panel support members, which are connected to a support frame structure, which holds the panels above the ground a specified distance. The panels are mounted on the support members such that they can be rotated about the horizontally extending members. In a first configuration, the panels are rotated such that they are horizontally planar and coextensive. In a second configuration, the panels are rotated so that they hang vertically, and preferably substantially parallel to each other in a side-by-side manner, which reduces the effective width for transportation.

In a fifth embodiment of the instant invention, the practice green comprises two panels, each consisting of a U-shaped, generally tubular member, with a canvas or other suitable fabric material stretched across the area within the tubular member. The U-shaped tubular member of the first panel has an inner diameter larger than the outer diameter of the U-shaped tubular member of the second panel, thereby allowing the side members of the first U-shaped tubular member to slide in a telescopic fashion over the smaller side members of the second U-shaped tubular member, thereby reducing the effective width for transportation. The fabric material is attached to the tubular U-shaped frame members so that the fabric loops slide along the frame members to facilitate the telescoping of the frame members to reduce or expand the effective width of the green surface.

Other features and advantages of the present invention will become apparent to those of skill in the art through a consideration of the ensuing description, the accompanying drawings and the appended claims.

BRIEF DESCRIPTION OF THE SEVERAL VIEWS OF THE DRAWINGS

The present invention will be better understood when the drawings are taken in conjunction with the description of the invention wherein.

DETAILED DESCRIPTION OF THE INVENTION

Figure 1:
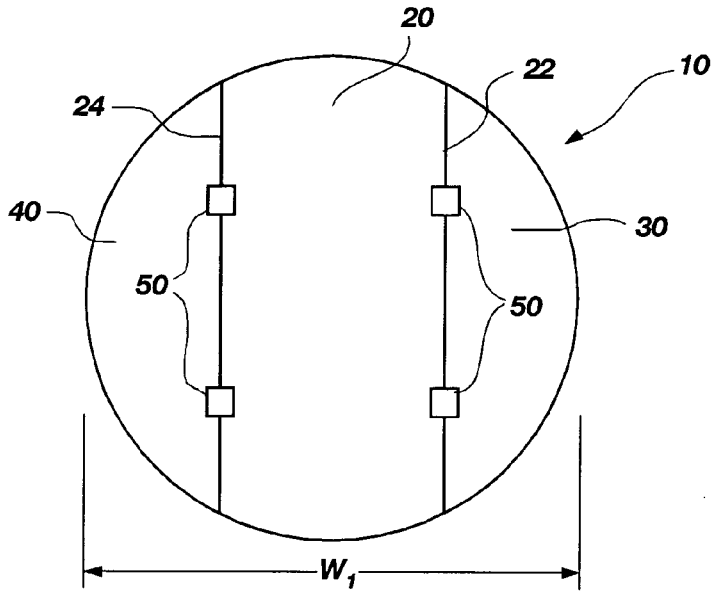
FIG. 1 is a top view of a golf practice green apparatus according to a first embodiment of the present invention in a first configuration.

Various embodiments of the present invention are described hereinafter with reference to the accompanying drawings. It should be understood that these illustrations are not to be taken as actual views of any specific apparatus or method of the present invention, but are exemplary representations employed to more clearly and fully depict the present invention than might otherwise be possible. Additionally, elements and features common between the drawing figures retain the same numerical designation. The drawings, however, are sufficiently detailed that one skilled in the art could construct an apparatus of the type described and illustrated.

Figure 2:
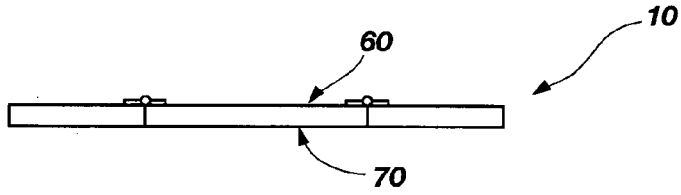
FIG. 2 is an end view of the golf practice green shown in FIG. 1.

FIG. 1 is a plan view of the upper surface of a golf practice green apparatus 10 according to a first embodiment of the present invention. The practice green comprises three panels, a center panel 20, a side folding panel 30, and an additional side folding panel 40. An edge of center panel 20 abuts an edge of side folding panel 30 at common joint 22. Hinges 50 are placed on the top surface 60 of panels 20 and 30 and fasten them together across common joint 22. Likewise, an edge of center panel 20 abuts an edge of side folding panel 40 at common joint 24. Hinges 50 also fasten panels 20 and 40 together across common joint 24. The hinges 50 may be positioned on the lower surface of the panels or recessed into the panel edges to be within the joint between adjacent panels. Recessed or bottom placed hinges may require the joints 22 and 24 to be more open and/or for the edges of the panels to be curved to accommodate the upward folding of a side panel with respect to the center panel. FIG. 2 is an end (elevational) view of the golf practice green shown in FIG. 1, illustrating the top impact surface 60 and bottom surface 70 of each of the panels. FIGS. 1 and 2 illustrate the golf practice green in a first configuration, in which the top surface 60 of each of the panels 20, 30, and 40 forms a co-planar continuous target surface, that would be used on a golf driving range for practicing golf swings, strokes, shots, etc. The practice green is placed anywhere on a driving range or course, while golfers attempt to hit balls from a "tee" area onto the practice green.

Figure 3:
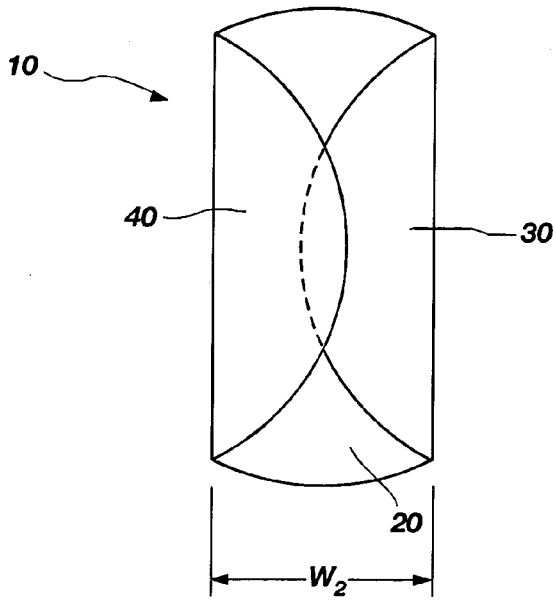
FIG. 3 is a top view of the golf practice green of FIG. 1 in a second configuration having a reduced effective width.

An operator of a driving range often would like to transport practice greens between different driving ranges or from the driving range to the location of a special event or competition. Such transportation often requires the practice green to be transported over state and federal highways. The effective width $W_1$ shown in FIG. 1 of typical practice greens is almost universally greater than the width allowed for vehicles by local laws, making transportation difficult if not impossible. The present invention allows a golf practice green to quickly be transformed into a second configuration as shown in FIG. 3, in which the effective width of the practice green has been significantly reduced to $W_2$. In this second configuration, side folding panel 30 has been folded over the top of center panel 20 along common joint 22. Side folding panel 40 has also been folded over the top of center panel 20 and a portion of side folding panel 30. The practice green apparatus 10 has been designed such that when placed in the second configuration, the effective width $W_2$ is within the legal limits allowed for transportation over roadways. The apparatus can then be placed on a trailer or other vehicle and transported over the road.

When the hinges are positioned on a lower surface or recessed, the side panels may not be foldable into a flat, overlapped position, but each may form an acute angle with respect to the upper surface of the center panel, thus decreasing the effective width to a permissibly transportable width. While having the side panels fold flat against one another is generally preferable, having the panels positioned at an acute angle is acceptable so long as the height of the side panel outer edges does not exceed the height permissible for clearance of underpasses, tunnels and the like.

Figure 4:
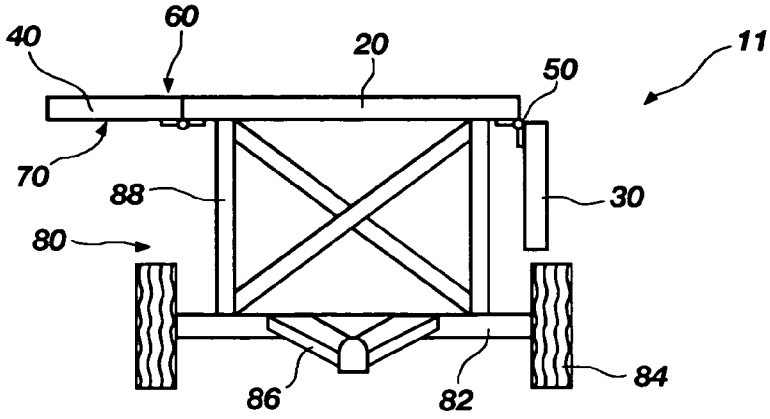
FIG. 4 is an end view of a golf practice green apparatus according to a second embodiment of the present invention showing one panel in a first configuration and another panel in the second configuration.

FIG. 4 is an end view of a golf practice green apparatus 11 according to a second embodiment of the present invention. The practice green apparatus is similar to that in the first embodiment, except that hinges 50 have been placed on the bottom surface 70 of panels 20, 30, and 40, and a support frame 80 has been attached to the bottom surface 70 of center panel 20. The support frame 80 comprises two wheels 84 mounted on an axle 82 that supports a frame structure 88 that positions panel 20 a predetermined height above the ground over the axle and wheels. The support frame further comprises a hitch device 86 for attachment to the tow hitch of a vehicle. The practice green of this embodiment may be a trailer or of a fold-down construction that may be used without wheels and placed upon a separate trailer.

In a first configuration, panels 30 and 40 are positioned horizontally, as shown by panel 40 in FIG. 4, such that the top surface 60 of panels 20, 30, and 40 forms a co-planar continuous target surface. The apparatus would be placed in the first configuration when it is being used as a golf target on a driving range. If it is desired to move the apparatus to a different location that requires transportation over a roadway, panels 30 and 40 can be folded downward relative to center panel 20 at the hinges 50 as shown by panel 30 in FIG. 4. The hitch device 86 can be used to connect the apparatus to a separate vehicle to tow the apparatus along the roadway to the desired location. While not specifically illustrated in FIG. 4, it should be understood that the apparatus would include all other elements necessary to make the apparatus capable of legal transportation along the roadway, such as tail lights, brakes, etc. The apparatus may also be constructed with two axles and sets of wheels if the size of the apparatus or the law so requires. A wheeled structure of this type is further advantageous inasmuch as it could be easily towed to different locations on a golf driving range.

Figure 5:
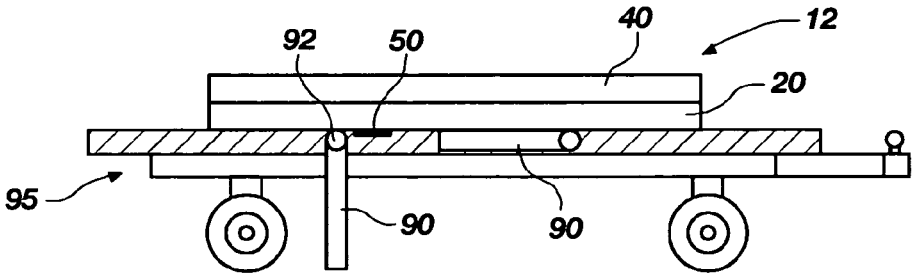
FIG. 5 is a side view of a golf practice green apparatus according to a third embodiment of the present invention positioned over a trailer vehicle.

FIG. 5 is a side view of a golf practice green apparatus 12 according to a third embodiment of the present invention positioned over a separate trailer vehicle. In this embodiment, the apparatus again comprises panels 20, 30, and 40. Hinges 50 are placed on the top surface 60 of panels 20, 30, and 40 as in the first embodiment. Support legs 90 are mounted to the bottom surface 70 of center panel 20 with pivot joints 92. In a first configuration, support legs 90 are extended 90° downward relative to center panel 20 and panels 30 and 40 extend horizontally as in the first configuration of the first and second embodiments. Legs 90 are of sufficient length to position the panels a predetermined height above the ground when the apparatus is in the first configuration. If it is desired to move the apparatus to a different location that requires transportation over a roadway, panels 30 and 40 can be folded over the top of panel 20 as shown in FIG. 3. A separate trailer vehicle 95 can then be positioned underneath the apparatus, legs 90 are folded using pivot joints 92 such that they extend horizontally as shown by the right leg 90 in FIG. 5, thereby lowering the apparatus onto the trailer 95. The trailer and golf practice green apparatus can then be legally towed over the road to the desired location.

While the present embodiment uses legs that pivot to lower the apparatus onto the trailer, it would be understood that any design of the leg that allows for changing of configuration, such as a retractable or collapsible (telescoping) leg, would be suitable for use. In addition, the bed of a truck or other suitable vehicle may be used to tow the golf practice green apparatus instead of a trailer if it is so desired.

Figure 6:
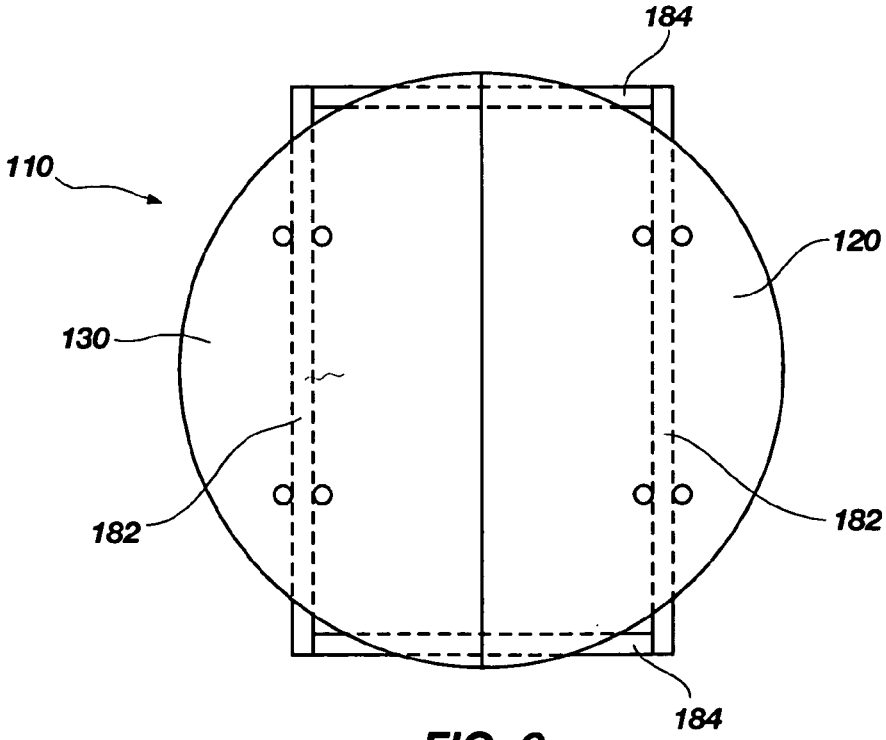
FIG. 6 is a top view of a golf practice green apparatus according to a fourth embodiment of the present invention in a first configuration.
Figure 7:
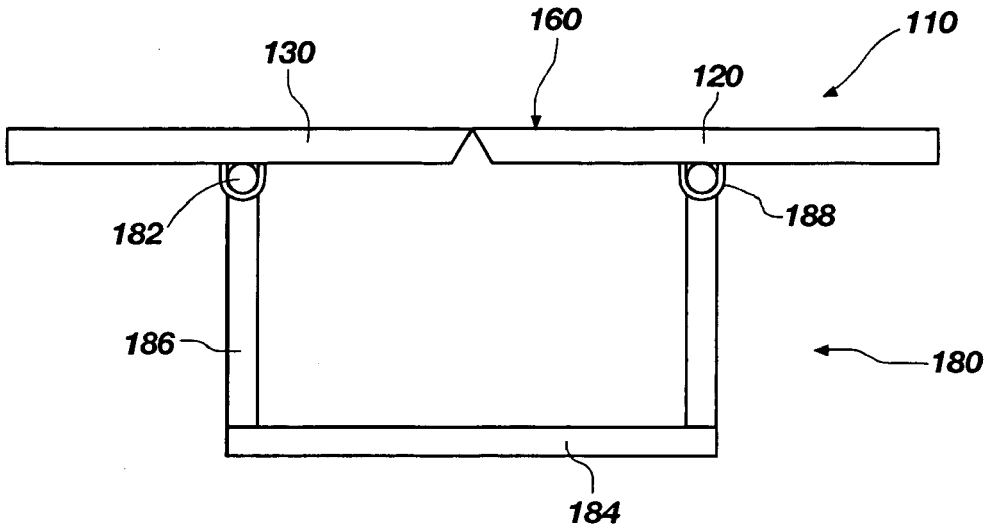
FIG. 7 is an end view of the golf practice green apparatus of FIG. 6.
Figure 8:
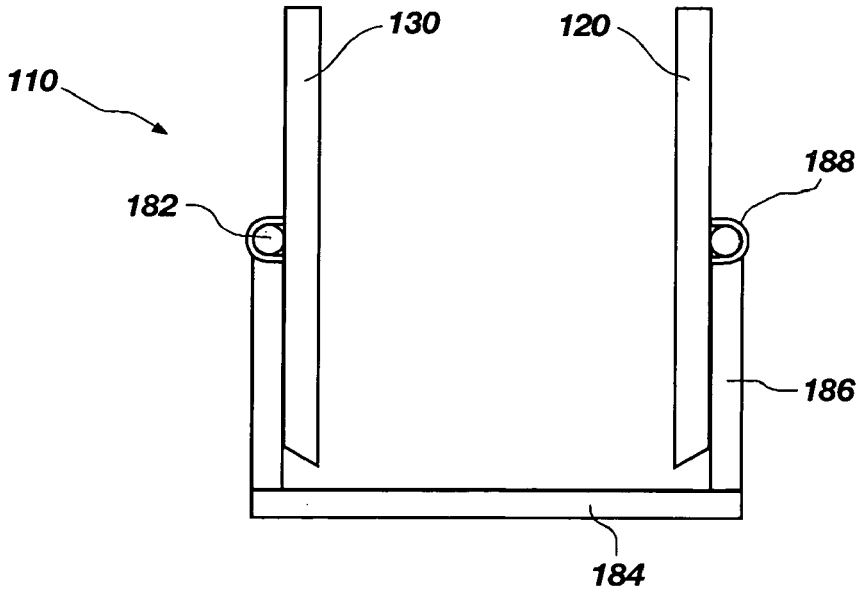
FIG. 8 is an end view of the golf practice green apparatus of FIGS. 6 and 7 in a second configuration having a reduced effective width.

FIGS. 6, 7 and 8 show a golf practice green apparatus 110 according to a fourth embodiment of the present invention. FIG. 6 is a top plan view of apparatus 110 in a first configuration, while FIGS. 7 and 8 are end views of the apparatus in the first configuration and a second configuration, respectively. The practice green apparatus comprises a first panel 120 and a second panel 130. The apparatus further comprises a support frame structure 180, which comprises a horizontal base member 184 connected to vertical members 186, which are further connected to horizontal support members 182. Panels 120 and 130 are connected to horizontal support members 182 by U-bolts 188, such that the panels are free to rotate about the horizontal support members.

In the first configuration, panels 120 and 130 extend horizontally such that the top surface 160 of the panels forms a co-planar and continuous surface as shown in FIG. 7. If it is desired to move the apparatus to a different location that requires transportation over a roadway, panels 120 and 130 can be rotated about horizontal support members 182 until they extend substantially vertically as shown in FIG. 8, thereby reducing the effective width of the apparatus. While the panels are illustrated as being folded inwardly, they also could be folded outwardly to nest along the outside of the structural framework. Outward folding may be desirable for very wide panels so they do not exceed permissible height regulations when folded into a vertical orientation. The practice green apparatus can then be placed on a trailer or other vehicle and transported legally over roadways. It would be understood that the apparatus of the fourth embodiment could also be constructed with an integral support frame structure and aligned wheels, such as that disclosed in the second embodiment, thereby allowing the golf green apparatus itself to be towed directly behind a vehicle without the need of a separate trailer. The horizontal base member 184 could, for such latter purpose, be an axle or axle support.

Figure 9:
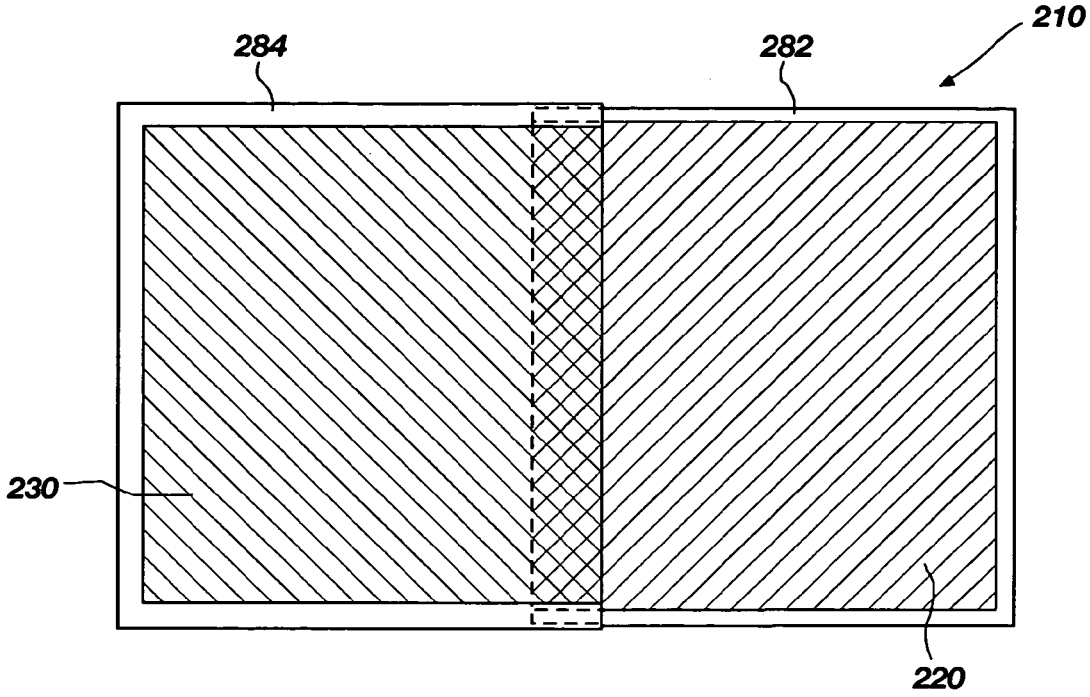
FIG. 9 is a top view of a golf practice green apparatus according to a fifth embodiment of the present invention in a first configuration.
Figure 10:
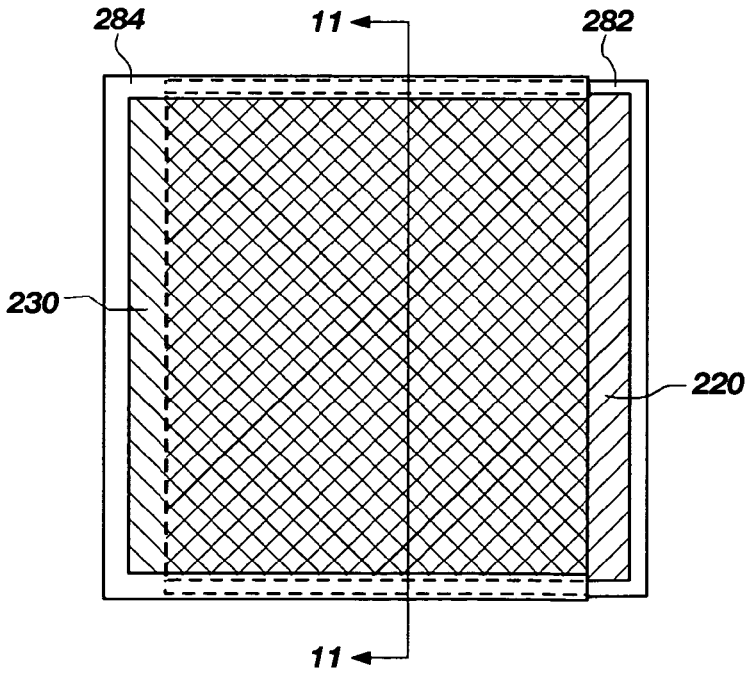
FIG. 10 is a top view of the golf practice green apparatus of FIG. 9 in a second configuration having a reduced effective width.

FIGS. 9 and 10 illustrate a golf practice green apparatus 210 according to a fifth embodiment of the present invention. The apparatus comprises a rigid tubular U-shaped frame member 282. A canvas or other suitable fabric panel 220 is fastened to, and extends across the area enclosed by, U-shaped frame member 282. The apparatus further comprises an additional rigid generally tubular U-shaped frame member 284 attached to an additional canvas panel 230. As is seen in the cross-sectional view of FIG. 11, taken along line 11—11 of FIG. 10, generally tubular frame member 284 is larger in cross-section than tubular frame member 282. The inner open diameter of tubular frame member 284 is slightly larger than the outer diameter of tubular frame member 282 so that tubular frame member 284 may slide telescopically over tubular frame member 282. Panel 230 is attached to the top surface of tubular frame member 284, while panel 220 is attached to the inside surface of tubular frame member 282. A slot 290 is formed in tubular frame member 284 along the inside surface thereof, such that when tubular frame member 284 slides telescopically over tubular frame member 282, panel 220 passes through the slot 290 in tubular frame member 284. Also, the canvas or fabric panel may be attached by spaced loops to the frame members so that the panels fold, accordion style, to permit the telescoped compact condition of the frame members.

In the first configuration as shown in FIG. 9, tubular frame member 284 slides telescopically over tubular frame member 282 only a short distance, providing a relatively large golf target surface. If it is desired to move the apparatus to a different location, tubular frame member 284 can slide telescopically over a substantial portion of tubular frame member 282 as shown in FIG. 10, thereby reducing the effective width of the apparatus. The practice green apparatus 210 can then be placed on a trailer or other vehicle and transported legally over roadways. It would be understood that the apparatus of the present embodiment could also be constructed with an integral support frame structure, such as that disclosed in the second embodiment, thereby allowing the golf green apparatus 210 itself to be towed directly behind a vehicle without the need of a separate trailer. While a telescopically sliding concentric tubular mechanism has been disclosed as a preferred embodiment, other mechanisms allowing panel 230 to slide over panel 220, such as wheels and a track, sliding cams, etc., are considered to be within the scope of the present invention.

It is to be understood that while means for locking the moving parts of the preferred embodiments into their respective first and second configurations have not been discussed in detail, such as pins, latches, straps, etc., such features are beneficial and considered to be within the scope of the instant invention and within the skill of one skilled in the mechanical arts.

While not specifically illustrated in the figures or incorporated into the preferred embodiments, it is to be understood that additional features commonly used with such practice greens, such as a "cup" or "hole," pin, flag, and target circles, may be readily incorporated into the design of the practice greens illustrated in the preferred embodiments of the present invention. Additionally, golf ball impact sensing means can be placed on the top impact surface of the practice greens, and used in conjunction with lamp means or other signaling means to relay information about the location of the impact of the golf ball on the target surface of the practice green to the golfer.

Figure 11:
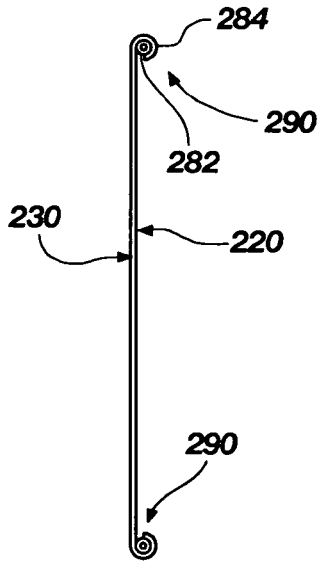
FIG. 11 is a cross-sectional side view of FIG. 10 taken along line 11—11.

With respect to the fabric upper surface referred to as part of FIGS. 9, 10 and 11, the fabric may be an open mesh where the openings are considerably smaller than a golf ball. A spider-web structure of wires with sensing devices at the intersection of the web members may be laid over the fabric surface or clipped by suitable clipping means to the under surface of the fabric to provide sensing means suitably connected to a lighting system upon a central flag pole, for example, wherein differently colored lamps illuminate to indicate how closely a ball hit proximate to the "pin."

The practice green, when equipped with impact sensors, has an electrical power source, such as a battery, fuel cell, or internal combustion generator, which provides electrical power to provide illumination to certain lamps when a ball impacts upon the putting green surface at a particular distance from the "pin."

The easily transportable practice green of the instant invention is particularly advantageous inasmuch as it can be equipped with wheels in various embodiments so that the green may be towed by a golf cart, for example, to different locations on a driving range or golf course, so that chip shots, sand shots, and mid-range iron shots can be practiced at various distances.

The greens of the instant invention may be equipped with an encircling skirt which depends from the outer perimeter of the green to reach, preferably, to the ground. The skirt may thus prevent golf balls from rolling under the green whenever they are hit short of the green. The skirt is preferably readily detachable from the green structure so that it is not harmed or worn whenever the green is folded and transported. The lower margin of the skirt may be weighted in order to contact the ground firmly to prevent rolling golf balls from rolling under the skirt.

The skirt may further be utilized as a space for advertisement or similar uses. Further, the skirt may provide support for small lamps, LEDs or the like to signal "hits" near the pin or as illumination during night-time use of the green. The skirt may be an integral unit or composed of discrete, depending fabric panels.

It is further within the scope of the invention that a suitable motor can be incorporated into the practice green structure to power the wheels to make the device a self-powered mobile device for movement from one location on a golf course or driving range to another location on the course or range. The motor can be a battery powered electric motor or a small internal combustion engine or similar power device.

Finally, while each of the preferred embodiments illustrate a flat planar golf ball impact surface, it is well known within the art to provide an impact surface that is contoured both for the function of simulating a natural golf green, or for the purpose of providing a mechanism for gathering golf balls to a particular location or for rolling off the golf green. Golf practice green apparatus capable of achieving multiple configurations having a contoured or sloped impact surface are considered to be within the scope of the present invention. Also, each of the preferred embodiments discloses practice greens having a periphery shaped as a circle or a rectangle. It is understood that practice greens having any peripheries or any geometric shape, or any arbitrary pattern are considered to be within the scope of the present invention.

What is claimed is:

1. A roadway-transportable apparatus comprising:

(a) a golf ball target surface configured for use on a golf driving range as a target practice green by a person hitting a ball towards the target practice green from a remote tee area and formed of at least a pair of panels, each of said panels having a top impact surface and a bottom surface, said panels occupying a first configuration whenever said panels are positioned about 180° with respect to one another, in said first configuration said panels abutting together along a common joint, said top impact surfaces of said panels being substantially coplanar and coextensive, thereby forming said golf ball target surface;

(b) configuration adjustment means operatively connected with said panels, said adjustment means being capable of positioning said panels in a second configuration, in said second configuration said top impact surfaces of said panels being substantially non-planar and discontinuous, and an effective width of said apparatus being significantly less than when said panels are in said first configuration; and (c) a support frame comprising:

(1) at least one axle;

(2) at least two wheels attached to said at least one axle;

(3) a support structure mounted on said at least one axle and attached to said at least a pair of panels; and (4) means for connecting said axle to a vehicle, whereby said golf ball target surface may be collapsed to said second configuration and legally towed on a highway.

2. The roadway-transportable apparatus of claim 1, wherein said configuration adjustment means comprises at least one hinge fastened to said panels across said common joint.

3. The roadway-transportable apparatus of claim 2, wherein said at least a pair of panels comprises:

(a) a center panel, (b) a first folding panel capable of abutting said center panel along a first edge thereof along a first common joint, and (c) a second folding panel capable of abutting said center panel along a second edge thereof along a second common joint, whereby said second configuration is attained by folding said first and second folding panels approximately 90° relative to said center panel.

4. The roadway-transportable apparatus of claim 1, further comprising golf ball impact sensing means mounted on at least one of said panels.

5. The roadway-transportable apparatus of claim 4, further comprising an electrical circuit including energy storage means and lamp means, the electrical circuit being interconnected with the golf ball impact sensing means such that the impact of a golf ball landing on said impact sensing means enables the electrical circuit for momentarily illuminating said lamp means.

6. The roadway-transportable apparatus of claim 1, wherein said configuration adjustment means comprises at least a pair of horizontally extending elongated panel support members, rotating means attaching said bottom surface of said panels to said panel support members along a substantial length thereof, whereby said second configuration is attained by rotating said panels about said panel support members.

7. The roadway-transportable apparatus of claim 6, wherein said configuration adjustment means further comprises:

(a) a static support member, and (b) at least a pair of pivot arms having a first end and a second end, said first end of said pivot arms being pivotably attached to said static support member, said second end of said pivot arms being pivotably attached to said panel support members whereby said second configuration is further attained by rotating said pivot arms relative to said static support member.

8. The roadway-transportable apparatus of claim 1, wherein said at least a pair of panels comprises a first panel and a second panel, said configuration adjustment means comprising a means for sliding said first panel over said second panel.

9. The roadway-transportable apparatus of claim 1, wherein said effective width of said apparatus in said first configuration is greater than a maximum vehicle width legally allowed for a particular road over which said apparatus is transported, and wherein said effective width of said apparatus is sufficiently reduced in said second configuration to allow the legal transportation of said apparatus over said particular road.

* * * * *